United States Patent [19]

Röck et al.

[11] 4,349,941

[45] Sep. 21, 1982

[54] MULTI-PINTLE HINGE WITH SLIDING SPRING CLOSING MECHANISM

[75] Inventors: Erich Röck; Josef Brunner, both of Höchst, Austria

[73] Assignee: Julius Blum Gesellschaft m.b.H., Höchst, Austria

[21] Appl. No.: 160,737

[22] Filed: Jun. 18, 1980

[30] Foreign Application Priority Data

Jul. 4, 1979 [AT] Austria ..... 4649/79

[51] Int. Cl.[3] ..... E05F 1/12

[52] U.S. Cl. ..... 16/288

[58] Field of Search ..... 16/50, 190, 145, 288, 16/327

[56] References Cited

U.S. PATENT DOCUMENTS

| | | | |
|---|---|---|---|
| 4,083,082 | 4/1978 | Holmes | 16/145 |
| 4,091,500 | 5/1978 | Lautenschlager | 16/145 |
| 4,251,900 | 2/1981 | Lautenschlager | 16/145 |

FOREIGN PATENT DOCUMENTS

| | | | |
|---|---|---|---|
| 2804243 | 8/1978 | Fed. Rep. of Germany | 16/150 |

*Primary Examiner*—Werner H. Schroeder
*Assistant Examiner*—Andrew M. Falik
*Attorney, Agent, or Firm*—Wenderoth, Lind & Ponack

[57] ABSTRACT

A furniture hinge includes a hinge arm and a hinge casing connected by two hinge links. A pressure spring is situated on the hinge arm and urges a retaining member onto a sliding member fixed to one of the hinge links, thus holding the hinge closed by the force of the spring, when the hinge is in the closed position.

6 Claims, 3 Drawing Figures

MULTI-PINTLE HINGE WITH SLIDING SPRING CLOSING MECHANISM

BACKGROUND OF THE INVENTION

FIELD OF THE INVENTION

The present invention relates to a hinge with a closing mechanism, particularly for furniture doors, comprising a first stop member in the form of a hinge arm linked to a second stop member, e.g. a hinge casing, by means of two hinge links, and a retaining member which is mounted in the hinge arm and acted upon by a spring for pressing lon one of the hinge links with a guiding member for creating a closing pressure.

DESCRIPTION OF THE PRIOR ART

In modern furniture construction, there has been an increasing demand for hinges with a closing mechanism in order to obtain a better support for the closed door and, further, to make a separate closing member, e.g. a magnetic catch, on the piece of furniture unnecessary.

In conventional hinges, one stop member is generally a hinge arm, and the second stop member is a hinge casing. The closing mechanism can be arranged in any of the two members.

It has proved to be disadvantageous to arrange the closing mechanism in the hinge casing as a high counter-pressure has to be overcome when closing the door. As a result, the door frequently closes with a bang, thereby exposing the other hinge parts, particularly the hinge links and the hinge axles, to high stess.

Therefore, the closing mechanism increasingly has been arranged in the hinge arm so that no closing pressure is exerted on the door wing when the door is open. Such pressure is only exerted when the door is closed or almost closed. The door is almost closed, when it includes an angle of about 5° to 10° with the plane of the closed door.

It is generally a disadvantage of prior art hinges with a closing mechanism that the hinge arm must be relatively large in order to be able to accomodate the required parts. In many cases, the height of the hinge arm, i.e. the distance between the furniture side wall and the back of the hinge arm, becomes too great.

SUMMARY OF THE INVENTION

It is, therefore, the object of the present invention to provide a hinge of the afore-described kind in which the closing mechanism can be arranged in an extremely space saving manner and in which the required closing pressure is produced at the same time.

The hinge and the closing mechanism in accordance with the present invention shall be of particular advantage in the production of so-called mini bands.

In accordance with the present invention, this is achieved by guiding the retaining member exclusively linearly in the hinge arm and, further, by movably guiding the retaining member substantially parallel to the mounting plane of the hinge arm, the retaining member being held in a recess on the center flange of U-shaped hinge arm, the two lateral rims defining the recess extending into grooves provided in the retaining member.

A further embodiment provides that the hinge link acted upon by the retaining member carries a sliding member resting aginst faces forming a guiding member and transmitting the pressure from the retaining member to the hinge link, the retaining member and the sliding member being preferably made of plastics material, particularly of the same plastics material.

By providing a separate sliding member, the friction which is not desired, when opening and closing the door, is substantially reduced.

It is preferably provided that the sliding member is mounted on the axle of the hinge link arranged on the side of the hinge arm and that the sliding member is an isosceles triangle in a section vertical to the hinge link axles (FIGS. 1,2). Hence, the sliding member is mounted in a safe and simple manner and fastened to the hinge link.

A further embodiment provides that the sliding member carries a covering member resting against the retaining member when the hinge is open.

When the door is in the open position, the covering member covers the region in which the retaining member presses against the sliding member, thereby protecting the parts from dust.

A further preferred embodiment provides that the guiding curve of the retaining member comprises straight and concave surfaces.

BRIEF DESCRIPTION OF THE DRAWINGS

In the following an embodiment of the present invention will be described in greater detail with reference to the accompanying drawings, without being limited thereto, and wherein.

DESCRIPTION OF THE PREFERRED EMBODIMENT

Figure 3:
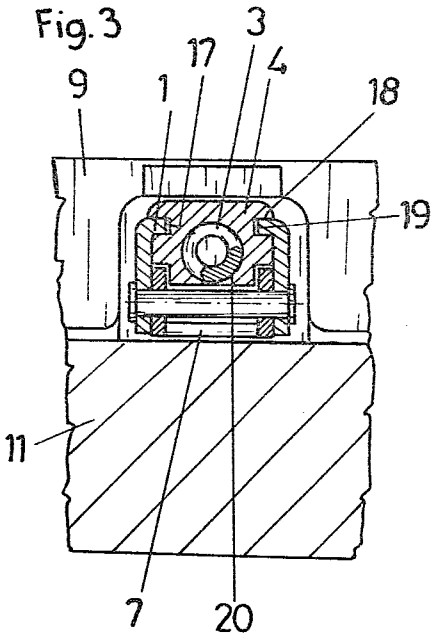
FIG. 3 is a sectional view along line III—III of FIG. 1.
Figure 1:
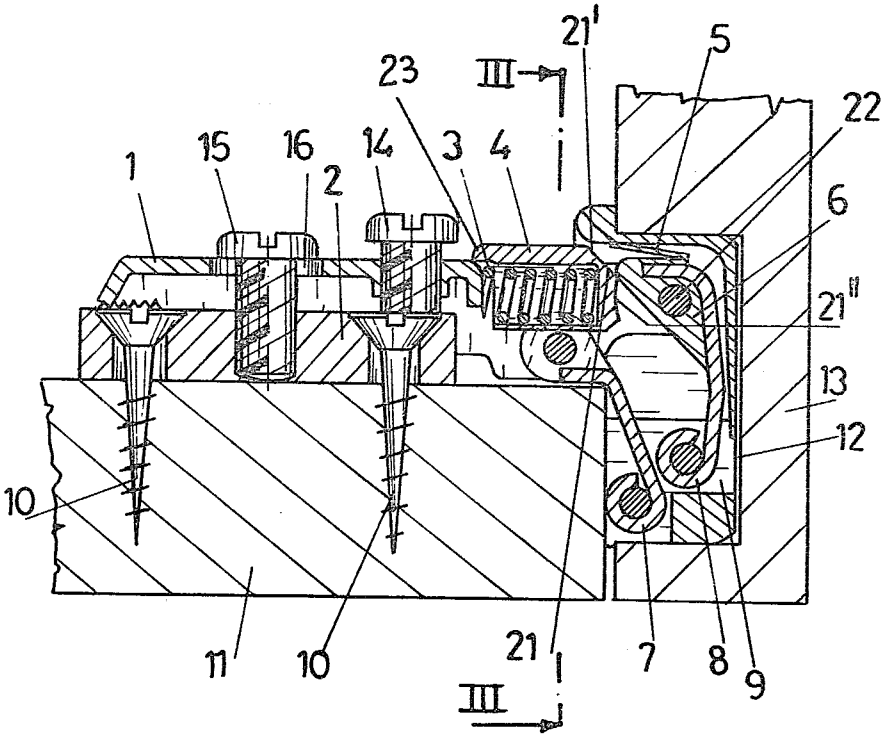
FIG. 1 is a horizontal sectional view of a hinge in accordance with the present invention and the furniture parts connected thereto, when the door is closed.
Figure 2:
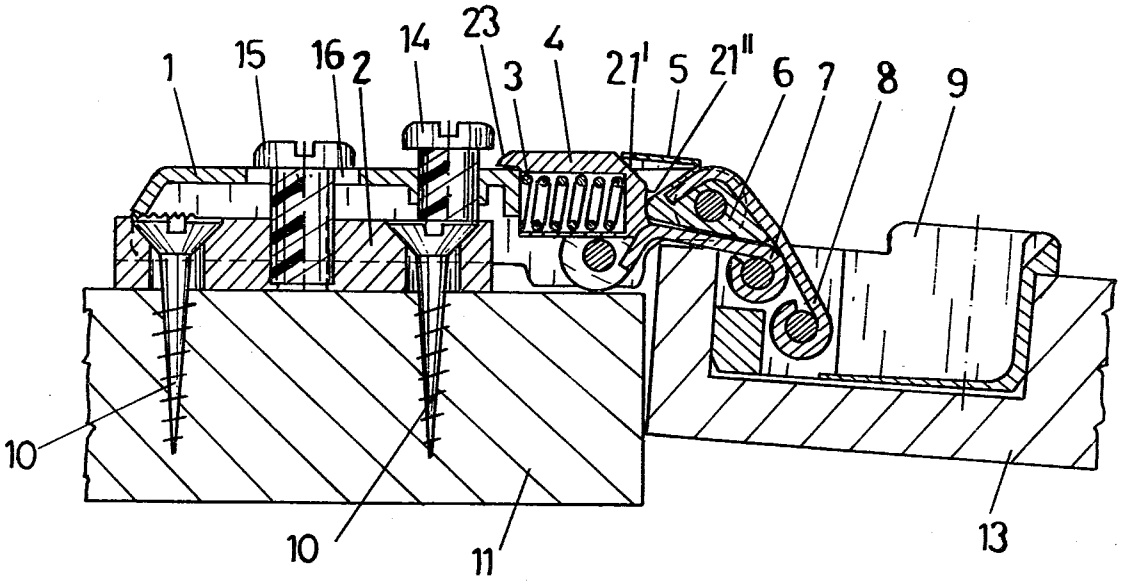
FIG. 2 is a similar sectional view, shown when the door is open.

The first stop member of the hinge in accordance with the present invention is the hinge arm 1, and the second stop member is the hinge casing 9. The hinge arm 1 and the hinge casing 9 are linked to each other by inner and outer hinge links 7, 8, respectively.

The terms "inner" and "outer" referring to relative location to the front or outer portion of an article of furniture including a side wall 11 and a door 13.

The hinge arm 1 is mounted on a base plate 2, which in this embodiment is fastened to the furniture side wall 11 by means of screws 10.

The hinge casing 9 is inserted in a bore 12 in the door 13.

Furthermore, an adjusting screw 14 for the joint adjustment of the door is mounted in the hinge arm 1.

The hinge arm 1 is retained on the base plate 2 by a clamping screw 15 mounted in a female thread in the base plate 2, the hinge arm having a slot 16 which allows an adjustment in the direction of the depth of the piece of furniture.

The hinge arm 1 has a generally U-shaped configuration including a pair of legs directed toward side wall 11 and a web joining the legs. The web has a recess 17 at its front end directed towards the door 13. A retaining member 4 is mounted in the recess 17. Retaining member 4 has grooves 18 into which two lateral rims 19 defining the recess 17 extend. Hence, the retaining member 4 is held and guided in the hinge arm 1 without any special guiding means.

A hole 20 in which a coil spring 3 is mounted is arranged in the retaining member 4, coil spring 3 resting with one end against the retaining member 4 and with the other end against the hinge arm 1.

The retaining member 4 is pressed against the hinge link 8 by means of the coil spring 3.

The retaining member 4 is at its front end provided with a guiding member 21 having a straight or planar surface 21' and a concave curved surface 21''.

The hinge link 8 has a sliding member 6 at its end directed towards the retaining member 4, sliding member 6 being rigidly connected with the hinge link 8 and, in accordance with this embodiment, mounted on an axle 22 connecting the hinge link 8 to the side of the hinge arm.

The sliding member 6 makes a two-arm lever of the hinge link 8.

When the door is closed or almost closed, the retaining member 4 presses with its straight surface 21' on the outer end of the sliding member 6 and exerts torque on the hinge link 8, whereby the door 13 is pressed into its closed position.

When the door 13 is open, the retaining member 4 presses with its concave surface 21'' on the free end of the sliding member 6 and radially on the hinge link axle 22. No torque is exerted in this case. When the door 13 is moved, the frictional forces between the retaining member 4 and the sliding member 6 have to be overcome. Such frictional forces can be greatly reduced by employing suitable materials.

In this embodiment, the sliding member 6 is provided with a covering member 5 resting against the retaining member 4 when the door 13 is open.

The retaining member 4 is at its rear rim provided with a projection 23 covering the joint between the hinge arm 1 and the retaining member 4.

What is claimed is:

1. A furniture hinge including a closing mechanism and comprising:

a hinge arm adapted to be mounted on a side wall of an article of furniture;

a hinge casing adapted to be mounted on a door of the article of furniture;

an inner hinge link and an outer hinge link connecting said hinge casing to said hinge arm, adjacent first ends of said inner and outer hinge links being pivotally connected to said hinge arm by respective axles, adjacent second ends of said inner and outer hinge links being pivotally connected to said hinge casing by respective axles, and said inner hinge link adapted to be positioned closer to the furniture side wall than is said outer hinge link when said hinge is connected to the article of furniture;

said hinge arm having a generally U-shaped cross-sectional configuration including a pair of legs adapted to be directed toward the furniture side wall and a web joining said pair of legs, said web having a forward end directed toward said hinge casing, said forward end of said web having therein a recess defined by a pair of inwardly extending lateral rims integral with said legs;

a retaining member mounted within said recess, said retaining member having on opposite sides thereof grooves receiving said rims, said retaining member being guided by said rims and grooves for linear movement only with respect to said hinge arm in opposite directions substantially parallel to the mounting plane of said hinge arm;

spring means for urging said retaining member linearly toward said hinge casing;

said outer hinge link including a sliding member directed generally toward said retaining member; and said retaining member having at a forward end thereof a guiding member directed toward said sliding member, said guiding member including first surface means for, when said hinge casing is in a door-closed position or almost door-closed position, contacting said sliding member under the force of said spring means and imparting to said outer hinge link a torque tending to move said hinge casing in a door-closed direction, and said guiding member including second surface means separate from said first surface means for, when said hinge casing is in a door-open position, contacting said sliding member under the force of said spring means without imparting torque to said outer hinge link.

2. A hinge as claimed in claim 1, wherein said retaining member and said sliding member are formed of plastic material having similar frictional properties.

3. A hinge as claimed in claim 1, wherein said sliding member is mounted on said axle connecting said first end of said outer hinge link to said hinge arm.

4. A hinge as claimed in claim 1, wherein said sliding member extends at an angle from said outer hinge link, whereby said outer hinge link and said sliding member form a two-arm lever.

5. A hinge as claimed in claim 1, wherein said sliding member includes a cover member contacting said retaining member when said hinge casing is in a door-open position.

6. A hinge as claimed in claim 1, wherein said first surface means comprises a planar surface, and said second surface means comprises a concave curved surface.

* * * * *